US011747068B2

(12) United States Patent
Lee et al.

(10) Patent No.: US 11,747,068 B2
(45) Date of Patent: Sep. 5, 2023

(54) ICE MACHINE

(71) Applicant: LG ELECTRONICS INC., Seoul (KR)

(72) Inventors: Donghoon Lee, Seoul (KR); Seungseob Yeom, Seoul (KR); Wookyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 139 days.

(21) Appl. No.: 17/299,266

(22) PCT Filed: Dec. 11, 2019

(86) PCT No.: PCT/KR2019/017448
§ 371 (c)(1),
(2) Date: Jun. 2, 2021

(87) PCT Pub. No.: WO2020/130473
PCT Pub. Date: Jun. 25, 2020

(65) Prior Publication Data

US 2022/0034570 A1 Feb. 3, 2022

(30) Foreign Application Priority Data

Dec. 18, 2018 (KR) ..... 10-2018-0164111

(51) Int. Cl.
*F25C 1/25* (2018.01)
*F25C 1/045* (2018.01)
*F25C 5/187* (2018.01)

(52) U.S. Cl.
CPC ..... *F25C 1/25* (2018.01); *F25C 1/045* (2013.01); *F25C 5/187* (2013.01);
(Continued)

(58) Field of Classification Search
CPC .... F25C 2400/08; F25C 1/25; F25C 2400/06; F25C 1/045; F25C 2500/06; F25C 5/187;
(Continued)

(56) References Cited

U.S. PATENT DOCUMENTS 4,505,130 A 3/1985 Hibino et al.
6,062,036 A 5/2000 Hobelsberger
(Continued)

FOREIGN PATENT DOCUMENTS

CN 101903718 A 12/2010
JP 2001194037 A 7/2001
(Continued)

OTHER PUBLICATIONS

English language translation of JP2005-351624. Translated Dec. 2022 (Year: 2005).*
(Continued)

*Primary Examiner* — Cassey D Bauer
(74) *Attorney, Agent, or Firm* — Bryan Cave Leighton Paisner LLP

(57) ABSTRACT

The present disclosure provides an ice machine including: a cabinet; a tray disposed inside the cabinet and having a plurality of cells for respectively forming ice cubes; and a nozzle disposed below the tray and spraying water toward the tray, wherein the plurality of cells includes a first cell having a smaller size and a second cell having a larger size than the first cell, and wherein the nozzle includes a first nozzle for spraying the water into the first cell and a second nozzle for spraying the water into the second cell.

20 Claims, 6 Drawing Sheets

(52) U.S. Cl.
CPC ..... *F25C 2400/08* (2013.01); *F25C 2400/14* (2013.01); *F25C 2600/04* (2013.01)

(58) Field of Classification Search
CPC ..... F25C 2400/14; F25C 2600/04; F25C 1/12–1/24
See application file for complete search history.

(56) References Cited

U.S. PATENT DOCUMENTS

| | | | |
|---|---|---|---|
| 2004/0237567 | A1 | 12/2004 | Nagasawa et al. |
| 2017/0003062 | A1 | 1/2017 | Olson, Jr. et al. |
| 2018/0017304 | A1 | 1/2018 | Knatt |
| 2018/0187941 | A1 | 7/2018 | An et al. |

FOREIGN PATENT DOCUMENTS

| | | | |
|---|---|---|---|
| JP | 2002130883 | A | 5/2002 |
| JP | 2005351624 | A | 12/2005 |
| JP | 2018105522 | A | 7/2018 |
| KR | 101443976 | B1 | 9/2014 |

OTHER PUBLICATIONS

English language translation of KR101443976. Translated Dec. 2022 (Year: 2014).*

* cited by examiner

[Fig. 1]
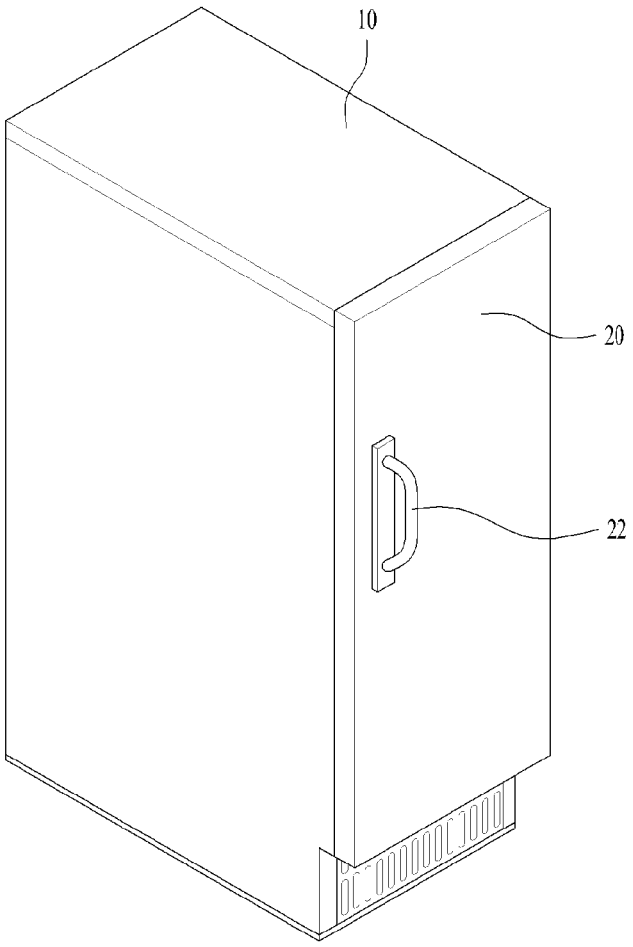

[Fig. 2]
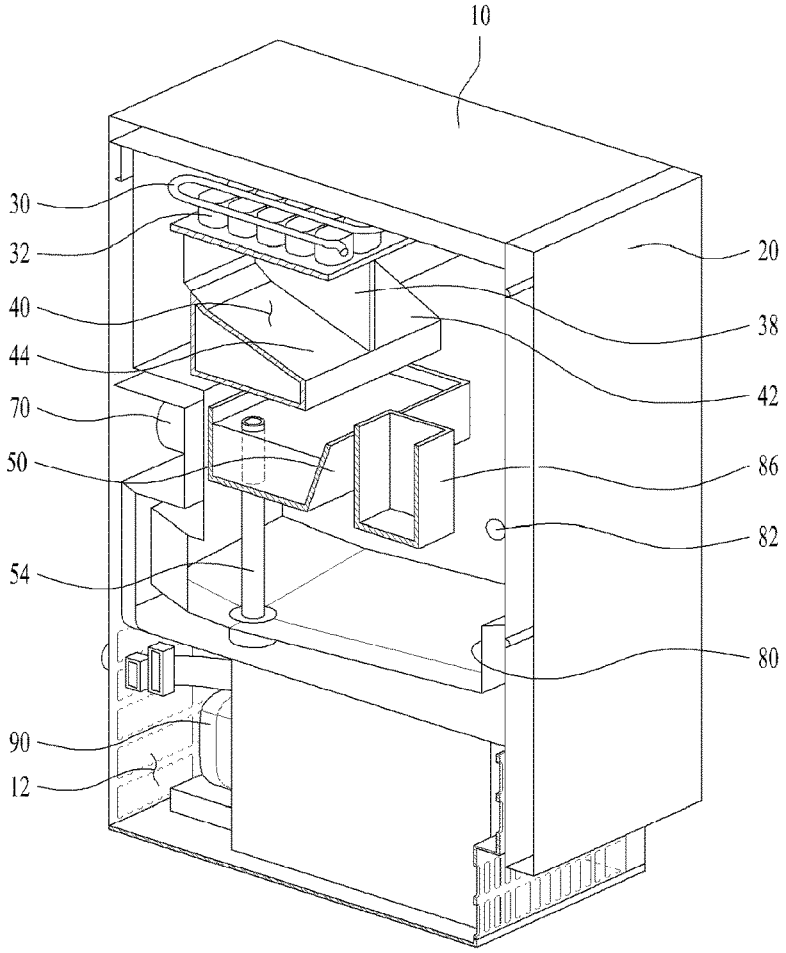
[Fig. 3]
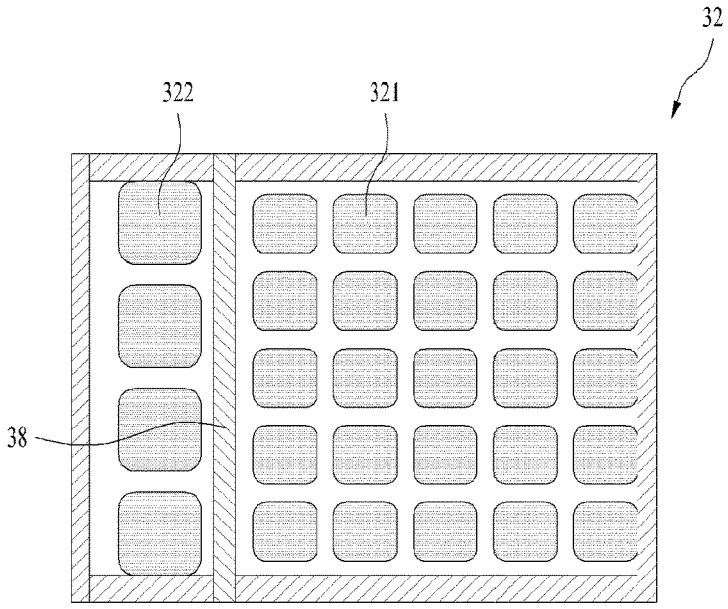

[Fig. 4]
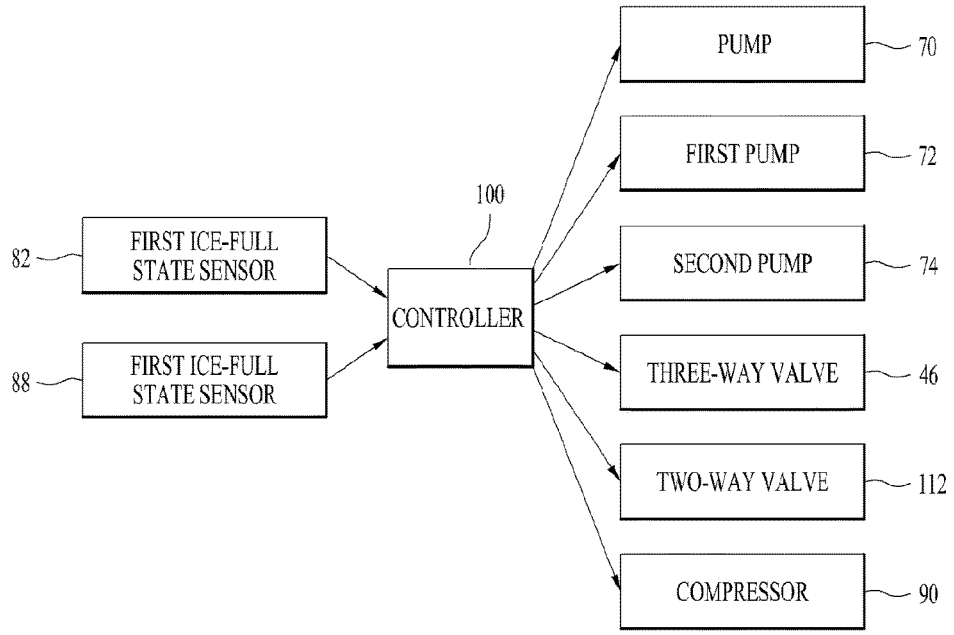
[Fig. 5]
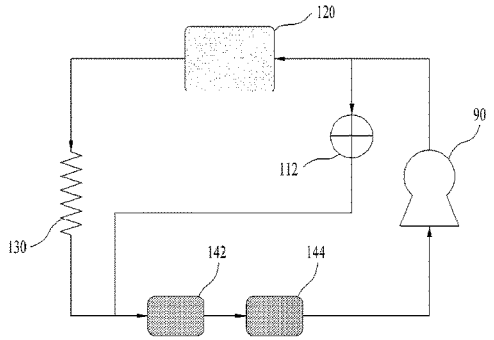
(a)
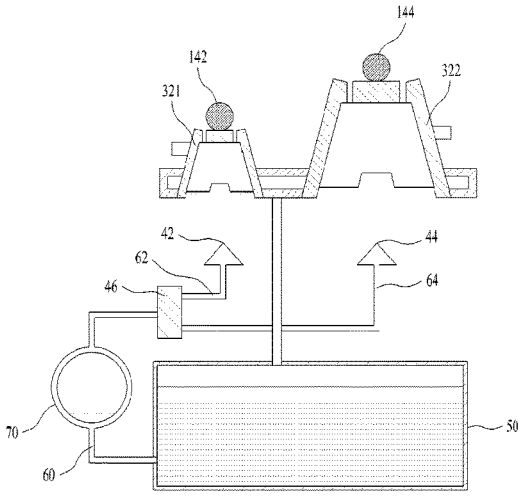
(b)

[Fig. 6]
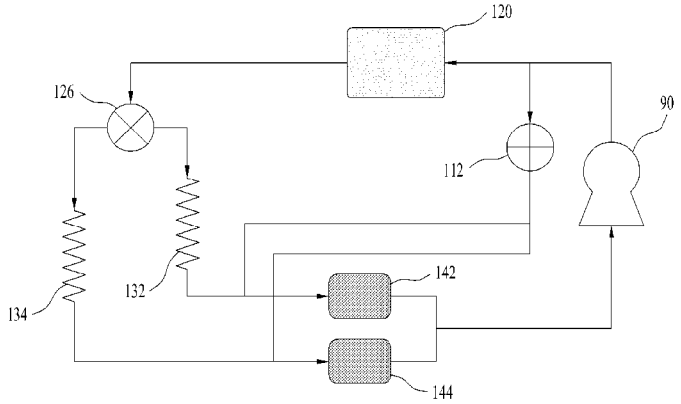
(a)
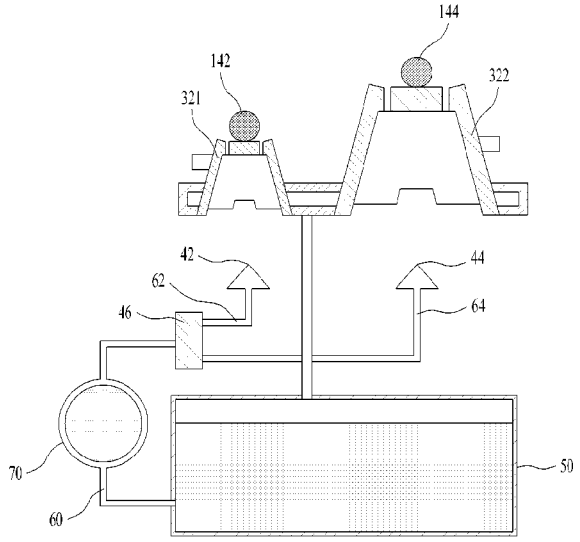
(b)

[Fig. 7]
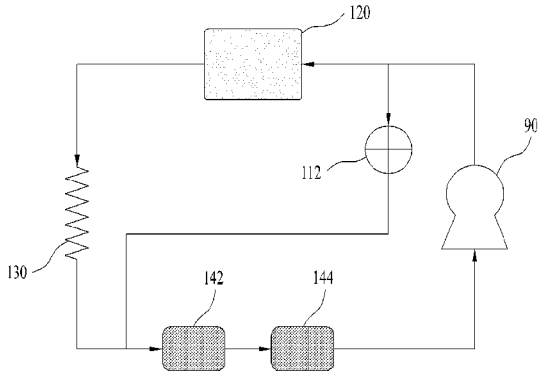
(a)
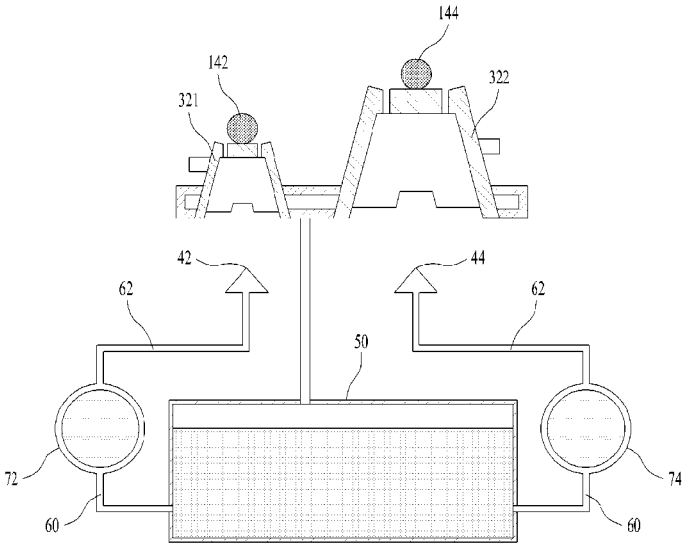
(b)

[Fig. 8]
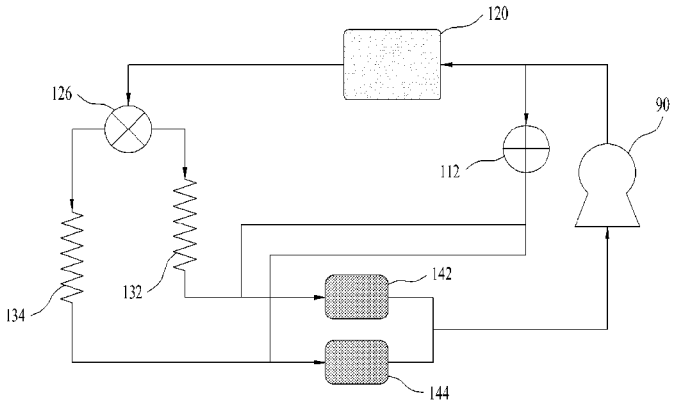
(a)
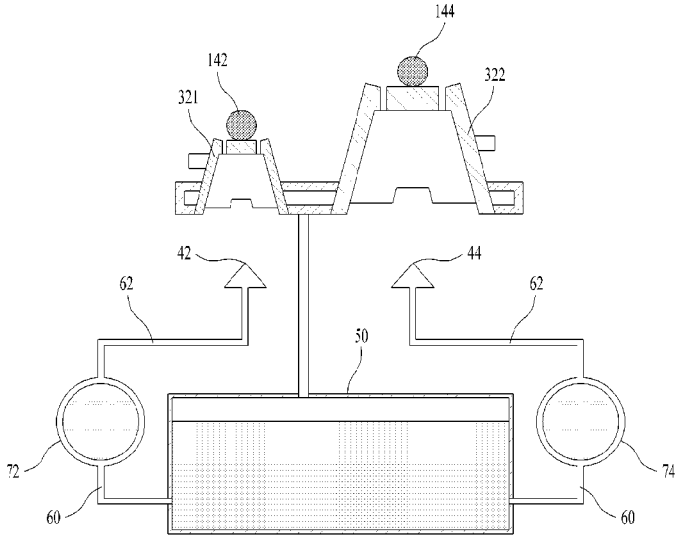
(b)

ICE MACHINE

This application is a National Stage Application of International Application No. PCT/KR2019/017448, filed on Dec. 11, 2019, which claims priority to Korean Patent Application No. 10-2018-0164111, filed on Dec. 18, 2018, which are hereby incorporated by reference in their entirety for all purposes as if fully set forth herein.

TECHNICAL FIELD

The present disclosure relates to an ice machine, and more particularly, to an ice machine that may make ice cubes of various sizes.

BACKGROUND ART

An ice machine installed in a kitchen sink for providing ice to a user typically has a structure in which transparent ice is made by applying a direct cooling cycle, an ice making portion for making the ice is disposed at a top of the ice machine, and the ice is transferred to an ice storage portion at a bottom of the ice machine through an ice-removal process and stored in the ice storage portion.

According to the prior art, the ice making portion has made only ice having the same size. However, such scheme does not satisfy requirements of a user who wants ice cubes of various sizes.

In one example, when the ice making portion includes a tray capable of making ice cubes of various sizes, the ice cubes of various sizes may be made by one tray. However, when ice cubes of a certain size are full on the tray, not entire ice cubes, which are made in the ice making portion, may be made, so that ice making is stopped.

Further, when the ice cubes of various sizes are made on one tray, time points at which the ice making is completed vary depending on the size of the ice cube. When ice-removal is performed at a time when making of ice, which is made within a relatively short time, is completed, it is difficult to make ice of a larger size.

DISCLOSURE OF INVENTION

Technical Problem

The present disclosure is to solve the above problems, and a purpose of the present disclosure is to provide an ice machine that may efficiently make ice cubes of various sizes.

Solution to Problem

The present disclosure provides an ice machine that provides ice cubes of multi-shapes from a conventional technique in which an ice machine of a spray water-circulating ice formation scheme provides ice cubes of a single shape.

The present disclosure provides an ice machine that has regions on a single tray where ice cubes of various shapes are formed, has a plurality of evaporators, and a plurality of nozzles to forming an independent ice making/ice removing system.

The present disclosure provides an ice machine that may make/remove/store ice cubes of various sizes in an ice making scheme of spraying water supplied from a storage tank to a tray, which is kept at a low temperature, using a pump to make ice.

Further, in order to make ice cubes of various types, the present disclosure attaches single-typed or plural-typed evaporation pipes to a tray to cool the tray to a temperature equal to or below a freezing point, and controls the evaporation pipes using pumps, valves, and the like.

Further, when a hot-gas cycle for ice-removal is applied after ice making is completed, a single or a plurality of hot-gas lines are formed to remove ice cubes. Whether each of a plurality of ice storage regions is in an ice-full state may be identified. Further, when the ice-full state occurs, additional ice may not be formed in an ice storage region of a tray in the ice-full state, during the ice making.

One aspect of the present disclosure proposes an ice machine including: a cabinet; a tray disposed inside the cabinet and having a plurality of cells for respectively forming ice cubes; and a nozzle disposed below the tray and spraying water toward the tray, wherein the plurality of cells includes a first cell having a smaller size and a second cell having a larger size than the first cell, and wherein the nozzle includes a first nozzle for spraying the water into the first cell and a second nozzle for spraying the water into the second cell.

In one implementation, the ice machine may further include a partition disposed between the first nozzle and the second nozzle to guide the water sprayed from the first nozzle and the water sprayed from the second nozzle not to be mixed with each other.

In one implementation, the ice machine may further include a storage tank for storing the water supplied to the first nozzle and the second nozzle therein, and a pump connected to the first nozzle and the second nozzle by a guide pipe and supplying the water stored in the storage tank to the first nozzle and the second nozzle.

In one implementation, the pump may include a first pump for supplying the water to the first nozzle and a second pump for supplying the water to the second nozzle.

In one implementation, the pump may include a three-way valve disposed at a portion where a flow path to the first nozzle and a flow path to the second nozzle are branched, wherein the three-way valve opens and closes each of the flow paths.

In one implementation, the ice machine may further include a first ice bin disposed below the tray and storing an ice cube falling from the first cell.

In one implementation, the ice machine may further include a first ice-full state sensor for detecting whether the first ice bin is in an ice-full state.

In one implementation, when the ice-full state is detected by the first ice-full state sensor, the water supplied from the first nozzle to the tray may be blocked.

In one implementation, the ice machine may further include a second ice bin disposed below the tray and storing an ice cube falling from the second cell.

In one implementation, the ice machine of claim may further include a second ice-full state sensor for detecting whether the second ice bin is in an ice-full state.

In one implementation, when the ice-full state is detected by the second ice-full state sensor, the water supplied from the second nozzle to the tray may be blocked.

In one implementation, when an ice is completely formed in the first cell, the water supplied from the first nozzle to the tray may be blocked.

In one implementation, when an ice is completely formed in the second cell, a refrigerant compressed by a compressor for compressing the refrigerant may be guided to an evaporator.

Advantageous Effects of Invention

According to the present disclosure, one tray is used to make ice cubes of different sizes together. Various ice cubes may be provided based on various ice use conditions, so that a convenience of use may be improved.

BRIEF DESCRIPTION OF DRAWINGS

FIG. 1 is a view illustrating an ice machine according to an embodiment of the present disclosure.

FIG. 2 is a view for illustrating an interior of FIG. 1.

FIG. 3 is a view for illustrating main portions of one embodiment.

FIG. 4 is a block diagram according to one embodiment.

FIG. 5 is a view for illustrating a concept of one embodiment.

FIG. 6 is a view for illustrating a concept of a variant.

FIG. 7 is a view for illustrating a concept of a further variant.

FIG. 8 is a view for illustrating a concept of a still further variant.

MODE FOR THE INVENTION

Hereinafter, a preferred embodiment of the present disclosure that may specifically realize the above purposes will be described with reference to the accompanying drawings.

In this process, a size, a shape, or the like of a component shown in the drawings may be exaggerated for clarity and convenience of description. In addition, terms that are specifically defined in consideration of the composition and operation of the present disclosure may vary depending on the intention of a user or an operator or a custom. Definitions of such terms should be made based on contents throughout the specification.

The present disclosure installs barriers to separate ice cubes based on ice size, so that sprayed water and removed ice are separated from each other. When ice making is completed in a tray with small volume of the ice, a flow path along which a refrigerant flows may be changed to prevent cold-air from being supplied toward an evaporator near the tray in which the ice making is completed. That is, various ice cubes may be separated on one tray by the ice-removal barriers and made.

FIG. 1 is a view illustrating an ice machine according to an embodiment of the present disclosure.

Referring to FIG. 1, an ice machine according to the present disclosure includes a cabinet 10 for forming an outer shape of the ice machine and a door 20 for opening and closing a front opening of the cabinet 10. The door 20 may be coupled to one side of the cabinet 10 to open and close the opening of the cabinet 10 while pivoting left and right about a pivoting shaft in a vertical direction.

A handle 22 is disposed at one side of the door 20, so that a user may grip the handle 22 of the door 20 to pivot the door 20.

FIG. 2 is a view illustrating the interior in a state in which a side of FIG. 1 is cut. Further, FIG. 3 is a view illustrating main portions of an embodiment.

Referring to FIGS. 2 and 3, a machine room 12 is defined below the cabinet 10. The machine room 12 has a compressor 90 disposed therein that compresses a refrigerant as one component of a freezing cycle. The compressor 90 may compress the refrigerant and finally generate cold air.

The machine room 12 may be defined in a lower portion of the cabinet 10 to reduce noise and vibration generated.

An evaporator 30 in which the refrigerant compressed by the compressor 90 is cooled while being evaporated is disposed at an upper portion of the cabinet 10. The evaporator 30 is formed in a pipe shape, and in contact with a tray 32. The tray 32 is cooled by the cold refrigerant passing through an interior of the evaporator 30, and then when water comes into contact with the cold tray 32, the water is converted into ice.

The evaporator 30 may be formed in a twisted shape to cool a space in which a plurality of ice cubes are generated defined in the tray 32. The tray 32 may include a plurality of cells in which the plurality of ice cubes are respectively generated.

Each first cell 321 having a relatively small size and each second cell 322 having a larger size than the first cell 321 are formed on the tray 32. Each first cell 321 and each second cell 322 are formed on one tray 32. Each first cell 321 and each second cell 322 are different in size from each other, so that a user may make ice cubes of various sizes by each ice made in each cell.

A nozzle 40 for spraying water toward the tray 32 is disposed below the tray 32. The nozzle 40 sprays the water in an upward direction to spray the water into each cell of the tray 32.

The nozzle 40 includes a first nozzle 42 for spraying water toward the first cell 321 and a second nozzle 44 for spraying water toward the second cell 322. Both nozzles spray water upwards, but due to different positions thereof, the water may be sprayed toward different cells.

A partition 38 is disposed between the first cell 321 and the second cell 322 of the tray 32. The partition 38 guides the water sprayed from the first nozzle 42 and the water sprayed from the second nozzle 44 not to mix with each other. The partition 38 guides the ice falling from the first cell 321 and the ice falling from the second cell 322 on the tray 32 not to be mixed with each other.

The partition 38 extends from a bottom of the tray 32 to a top of the nozzle 40 to intersect an intermediate portion of the tray 32. The nozzle 40 is inclined such that a vertical level of one side thereof is lower than that of the other side thereof, so that the ice falling from the tray 32 may be guided to fall along the inclination of the nozzle 40.

A storage tank 50 for storing water to be supplied to the nozzle 40 therein is disposed below the nozzle 40. The water supplied from the storage tank 50 may be guided to the first nozzle 42 and the second nozzle 44.

A drain pipe 54 is disposed in the storage tank 50, so that, when a water-level of the storage tank 50 exceeds a certain level, the water may be discharged from the storage tank 50 through the drain pipe 54. The drain pipe 54 is disposed in a form of a tube erected to have a certain vertical level inside the storage tank 50. When the water-level inside the storage tank 50 is higher than the vertical level of the drain pipe 54, as the water enters the drain pipe 54, the water-level of the storage tank 50 is no longer increased.

The water supplied from the storage tank 50 is guided to the nozzle 40 by a pump 70.

A first ice bin 80 and a second ice bin 86 are arranged below the storage tank 50, so that the ice cubes respectively supplied from the first cell 321 and the second cell 322 may be respectively stored in the first and second ice bins 80 and 86. The first ice bin 80 may be disposed below the first cell 321, and the second ice bin 86 may be disposed below the second cell 322.

In order to use the stored ice, the user may open the door 20, then access the first ice bin 80 or the second ice bin 86, and then scoop the ice. The drain pipe 54 extends downward to penetrate a bottom of the first ice bin 80, so that the water discharged from the drain pipe 54 is flowed to the bottom of the first ice bin 80.

The first ice bin 80 is provided with a first ice-full state sensor 82 that detects whether the ice supplied from the first cell 321 is full in the first ice bin 80. The second ice bin 86 is provided with a second ice-full state sensor 88 that detects whether the ice supplied from the second cell 322 is full in the second ice bin 86. The first ice-full state sensor 82 or the second ice-full state sensor 88 includes a light emitting unit or a light receiving unit. Thus, the first ice-full state sensor 82 or the second ice-full state sensor 88 detects that the first ice bin 80 or the second bin 86 is full, when the ice is loaded equal to or above a certain vertical level, and detects that the first ice bin 80 or the second bin 86 is not full, when the ice is loaded below the certain vertical level. When each ice bin is full, it may mean a state in which additional ice does not necessary to be supplied, while when each ice bin is not full, it may mean that there is a space for receiving additional ice.

FIG. 4 is a block diagram according to one embodiment.

Referring to FIG. 4, information associated with the ice-full states respectively detected by the first ice-full state sensor 82 and the second ice-full state sensor 88 is transmitted to the controller 100.

The pump 70 may include a first pump 71 and a second pump 72 to flow water to two flow paths, respectively. The controller 100 may drive or stop driving the pump 70, or the first pump 71 and the second pump 72. Since the nozzle 40 discharges the water upwards, and the nozzle 40 is located above the storage tank 50, when each pump is not driven, water cannot flow from the storage tank 50 to the nozzle 40. Therefore, when each pump is not driven, the water cannot be sprayed from the nozzle 40, and the water cannot be supplied to the tray 32.

The controller 100 may drive the compressor 90 to compress the refrigerant and allow the evaporator 30 to be cooled.

In addition, the controller 100 controls a two-way valve 112 and a three-way valve 46 to open and close flow paths, so that the flow path of each valve varies.

FIG. 5 is a view for illustrating a concept of one embodiment. FIG. 5A is a schematic diagram illustrating a movement of a refrigerant in an ice making process, and FIG. 5B is a conceptual diagram illustrating a process of supplying water from a storage tank.

Referring to FIG. 5A, when the refrigerant is compressed in the compressor 90, the refrigerant is condensed in a condenser 120. The refrigerant is vaporized while passing through an expansion valve 130, and the refrigerant is heat-exchanged in the first evaporator 142 and the second evaporator 144 to supply cold-air to the outside. The first evaporator 142 supplies the cold-air to the first cell 321, so that the ice may be formed in the first cell 321, and the second evaporator 144 supplies the cold-air to the second cell 322, so that the ice may be formed in the second cell 322.

Further, when the ice formation is completed, the two-way valve 112 opens a flow path, so that the hot refrigerant compressed in the compressor 90 is guided to the first evaporator 142 and the second evaporator 144 without passing through the condenser 120. Accordingly, temperatures of the first evaporator 142 and the second evaporator 144 increase, and temperatures of the first cell 321 and the second cell 322 also increase. Therefore, a portion of the ice formed in the first cell 321 attached to the first cell 321 or a portion of the ice formed in the second cell 322 attached to the second cell 322 melts, so that the ice drops from the first cell 321 or the second cell 322 to the first ice bin or the second ice bin. Further, the evaporator 30 includes the first evaporator 142 and the second evaporator 144.

Referring to FIG. 5B, the storage tank 50 is connected to the pump 70 by a guide pipe 60. The water in the storage tank 50 may flow to the pump 70 through the guide pipe 60.

The water passed through the pump 70 may be branched into a flow path 62 branched to the first nozzle 42 and a flow path 64 supplied to the second nozzle 44. The three-way valve 46 for opening and closing each of the flow paths 62 and 64 is disposed at a portion where the two flow paths branch. Even when the pump 70 is driven, depending on which flow path the three-way valve 46 opens, the water may or may not be supplied to the first nozzle 42 or the second nozzle 44. The water sprayed from the first nozzle 42 is directed toward the first cell 321, so that, when the temperature of the first cell 321 is low, the ice may be formed while the water comes into contact with the first cell 321. The water sprayed from the second nozzle 44 is directed toward the second cell 322, so that, when the temperature of the second cell 322 is low, the ice may be formed while the water comes into contact with the second cell 322. The first cell 321 is disposed to be in contact with the first evaporator 142, so that, when the cold-air is supplied from the first evaporator 142, the temperature of the first cell 321 is lowered. The second cell 322 is disposed to be in contact with the second evaporator 144, so that, when the cold-air is supplied from the second evaporator 144, the temperature of the second cell 322 is lowered.

In the embodiment of FIG. 5, the compressor 90 is driven, and the water is supplied from the first nozzle 42 and the second nozzle 44, so that the ice cubes may be formed in the first cell 321 and the second cell 322.

When the ice formation is completed in the first cell 321, the three-way valve 46 blocks the flow path 62 for supplying the water to the first nozzle 42. Since a size of the first cell 321 is smaller than that of the second cell 322, the ice may be formed faster in the first cell 321 than in the second cell 322. Therefore, even after the ice formation is completed in the first cell 321, the compressor 90 is driven such that the water is supplied to the second cell 322 through the second nozzle 44 to complete the ice formation in the second cell 322.

When the ice formation is completed in the second cell 322, the driving of the pump 70 is stopped to prevent the water from being sprayed into the second nozzle 44 as well as the first nozzle 42.

The controller 100 allows the two-way valve 46 to open the flow path, so that the hot refrigerant compressed by the compressor 90 is supplied to the first evaporator 142 and the second evaporator 144. As time elapses, each ice may fall from each of the first cell 321 and the second cell 322, and may be stored in each of the first ice bin 80 and the second ice bin 86.

When the first ice-full state sensor 82 detects that the first ice bin 80 is full with the ice cubes, the three-way valve 112 blocks the flow path 62. Further, when the second ice-full state sensor 88 detects that the second ice bin 86 is full with the ice cubes, the three-way valve 112 blocks the flow path 64. Therefore, no water is supplied to each nozzle, and no ice is generated in each cell, so that no additional ice is supplied to each ice bin.

FIG. 6 is a view for illustrating a concept of a variant. FIG. 6A is a schematic diagram illustrating a movement of a refrigerant during an ice formation process, and FIG. 6B is a conceptual diagram illustrating a process of supplying water from a storage tank. FIG. 6B is similar to FIG. 5B.

Further, FIG. 6A is similar to FIG. 5A. Thus, overlapping descriptions of similar components will be omitted.

Referring to FIG. 6, a three-way valve 126 is disposed to guide the refrigerant passed through the condenser 120 to two expansion valves 132 and 134. When the three-way valve 126 guides the refrigerant to the expansion valve 132, the refrigerant is supplied to the first evaporator 142, so that the ice may be formed on the first cell 321 where the first evaporator 142 is disposed. Further, when the three-way valve 126 guides the refrigerant to the expansion valve 134, the refrigerant is supplied to the second evaporator 144, so that the ice may be formed on the second cell 322 where the second evaporator 144 is disposed.

When the ice formation is completed in the first cell 321, the three-way valve 46 blocks the flow path along which the water is supplied to the first nozzle 42, so that the water is not sprayed from the first nozzle 42. In addition, the three-way valve 126 prevents the refrigerant from moving to the expansion valve 132, so that additional refrigerant is not supplied to the first evaporator 142.

When the ice formation is completed in the second cell 322, the driving of the pump 70 is stopped, and all of the flow paths along which the refrigerant is moved from the three-way valve 126 to the expansion valves 132 and 134 are blocked.

In order to move the ice on the tray 32 to the ice bin, the two-way valve 112 opens the flow path, so that the refrigerant compressed by the compressor 90 is guided to the first evaporator 142 and the second evaporator 144 without passing through the condenser.

Further, when the ice-full state is detected by the first ice-full state sensor 82, the three-way valve 46 blocks the flow path through which the water flows to the first nozzle 42, and the three-way valve 126 blocks the flow path through which the refrigerant moves to the expansion valve 132.

FIG. 7 is a view for illustrating a concept of a further variant. FIG. 7A is a schematic diagram illustrating a movement of a refrigerant during an ice formation process, and FIG. 7B is a conceptual diagram illustrating a process of supplying water from a storage tank. FIG. 7A is similar to FIG. 5A. Further, FIG. 7B is similar to FIG. 5B. Thus, overlapping descriptions of similar components will be omitted.

Referring to FIG. 7, the water stored in the storage tank 50 is guided to the first pump 72 and the second pump 74 through the guide pipe 60, respectively. The water guided to the first pump 72 and the second pump 74 may be guided to the nozzles 42 and 44 through the flow paths 62 and 64, respectively.

When the ice formation is completed in the first cell 321, the driving of the first pump 72 is stopped. Further, when the ice formation is completed in the second cell 322, the driving of the second pump 74 is stopped.

When the ice-full state of the first ice bin 80 is detected by the first ice-full state sensor 82, the driving of the first pump 72 is stopped.

When the ice formation is completed in the first cell 321 and in the second cell 322, the two-way valve 112 opens the flow path, so that the refrigerant compressed by the compressor 90 is guided to the first evaporator 142 and the second evaporator 144 without passing through the condenser, thereby increasing a temperature of the tray 32.

FIG. 8 is a view for illustrating a concept of a still further variant. FIG. 8A is a schematic diagram illustrating a movement of a refrigerant during an ice formation process, and FIG. 8B is a conceptual diagram illustrating a process of supplying water from a storage tank. FIG. 8B is the same as FIG. 7B, and FIG. 8A is the same as FIG. 6A.

When the ice formation is completed in the first cell 321, the driving of the first pump 72 is stopped, and the three-way valve 126 blocks a flow path along which the refrigerant moves to the first evaporator 142.

When the ice formation is completed in the second cell 322, the driving of the second pump 74 is stopped. Further, the three-way valve 126 blocks both the flow path along which the refrigerant moves to the first evaporator 142 and a flow path along which the refrigerant moves to the second evaporator 144. Since a size of the ice made in the second cell 322 is larger than the ice made in the first cell 321, when the ice formation is started in the first cell 321 and the second cell 322 at the same time, the ice formation is completed late in the second cell 322. Therefore, when the ice is formed in the second cell 322, it may be assumed that the ice is already formed in the first cell 321.

In order to move the ice cubes in the first cell 321 and the second cell 322 to the ice bins, the two-way valve 112 opens the flow path such that the refrigerant compressed by the compressor 90 may be moved directly to the first evaporator 142 and the second evaporator 144.

Further, when the ice-full state is detected by the first ice-full state sensor 82, the three-way valve 46 blocks the flow path along which the water flow to the first nozzle 42, and the three-way valve 126 blocks the flow path along which the refrigerant moves to the expansion valve 132.

The present disclosure is not limited to the above-described embodiment. Further, as seen from the appended claims, modifications are possible by those skilled in the art of the present disclosure, and such modifications fall within the scope of the present disclosure.

The invention claimed is:

1. An ice machine comprising:

a cabinet;

a tray disposed inside the cabinet and having a plurality of cells for respectively forming ice;

a nozzle disposed below the tray for spraying water toward the tray to form the ice, wherein the nozzle includes a first nozzle for spraying the water into the first cell and a second nozzle for spraying the water into the second cell, a partition disposed between the first nozzle and the second nozzle to separate the water sprayed from the first nozzle and the water sprayed from the second nozzle so as to not be mixed with each other, and wherein the plurality of cells includes a first cell and a second cell having a larger size than the first cell.

2. The ice machine of claim 1, further comprising:

a storage tank for storing the water supplied to the first nozzle and the second nozzle; and a pump connected to the first nozzle and the second nozzle by a guide pipe for supplying the water stored in the storage tank to the first nozzle and the second nozzle.

3. The ice machine of claim 2, further comprising:

a first ice bin disposed below the tray for storing the ice falling from the first cell.

4. The ice machine of claim 3, further comprising:

a first ice-full state sensor for detecting whether the first ice bin is in an ice-full state.

5. The ice machine of claim 4, further comprising:

a second ice bin disposed below the tray for storing the ice falling from the second cell.

6. The ice machine of claim 5, further comprising:

a second ice-full state sensor for detecting whether the second ice bin is in an ice-full state.

7. The ice machine of claim 6, wherein the pump communicates with a three-way valve that guides the water disposed at a portion where a flow path to the first nozzle and a flow path to the second nozzle are branched, wherein the three-way valve that guides the water opens and closes each of the flow paths.

8. The ice machine of claim 7, further comprising a controller, wherein when the ice-full state is detected by the first ice-full state sensor, the controller is configured to control the three-way valve that guides the water to close the flow path to the first nozzle.

9. The ice machine of claim 8, wherein when the ice-full state is detected by the second ice-full state sensor, the controller is configured to control the three-way valve that guides the water to close the flow path to the second nozzle.

10. The ice machine of claim 6, wherein the pump includes a first pump for supplying the water to the first nozzle and a second pump for supplying the water to the second nozzle.

11. The ice machine of claim 1, wherein when the ice is completely formed in the first cell, the water supplied from the first nozzle to the tray is blocked.

12. The ice machine of claim 11, wherein the water is continuously supplied from the second nozzle to the tray after the ice formation is completed in the first cell until the ice is completely formed in the second cell.

13. The ice machine of claim 1, wherein when the ice is completely formed in the first cell, a compressed refrigerant compressed by a compressor is guided toward the first cell.

14. The ice machine of claim 1, wherein when the ice is completely formed in the second cell, the compressed refrigerant compressed by the compressor is guided toward the second cell.

15. The ice machine of claim 1, further comprising a controller and a two-way valve, wherein when the ice is completely formed in the first cell and the second cell, the controller is configured to control the two-way valve to open to allow a compressed refrigerant compressed by a compressor to flow toward the first cell and the second cell.

16. An ice machine comprising:

a cabinet;

a tray disposed inside the cabinet and having a plurality of cells for respectively forming ice;

a nozzle disposed below the tray for spraying water toward the tray to form the ice, a controller and a three-way valve to guide a refrigerant passed through a condenser, wherein the plurality of cells includes a first cell and a second cell having a larger size than the first cell, wherein the nozzle includes a first nozzle for spraying the water into the first cell and a second nozzle for spraying the water into the second cell, and wherein when the ice formation is completed in the first cell, the controller controls the three-way valve to block the refrigerant from flowing to an expansion valve associated with the first cell.

17. The ice machine of claim 16, wherein when the ice formation is completed in the second cell, the controller controls the three-way valve to block the refrigerant from flowing to an expansion valve associated with the second cell.

18. An ice machine comprising:

a cabinet;

a tray disposed inside the cabinet and having a plurality of cells for respectively forming ice;

a nozzle disposed below the tray for spraying water toward the tray to form the ice, and a partition disposed to extend from a bottom of the tray to a top of the nozzle to intersect an intermediate portion of the tray, wherein the nozzle includes a first nozzle for spraying the water into a first cell and a second nozzle for spraying the water into a second cell.

19. The ice machine of claim 18, wherein the partition guides the ice falling from the first cell and the ice falling from the second cell on the tray not to be mixed with each other.

20. The ice machine of claim 18, wherein the partition is disposed between the first nozzle and the second nozzle to separate the water sprayed from the first nozzle and the water sprayed from the second nozzle.

* * * * *